US009788704B2

(12) United States Patent
Wallerstorfer et al.

(10) Patent No.: US 9,788,704 B2
(45) Date of Patent: Oct. 17, 2017

(54) DRYING APPARATUS FOR DOMESTIC MACHINES

(71) Applicant: SANHUA AWECO Appliance Systems GmbH, Neukirch (DE)

(72) Inventors: Kurt Wallerstorfer, Strasswalchen (AT); Rudolf Lonski, Golling (AT)

(73) Assignee: SANHUA AWECO APPLIANCE SYSTEMS GMBH, Neukirch (DE)

( * ) Notice: Subject to any disclaimer, the term of this patent is extended or adjusted under 35 U.S.C. 154(b) by 105 days.

(21) Appl. No.: 14/688,657

(22) Filed: Apr. 16, 2015

(65) Prior Publication Data

US 2015/0297057 A1 Oct. 22, 2015

(30) Foreign Application Priority Data

Apr. 16, 2014 (DE) ..... 10 2014 005 539

(51) Int. Cl.
*A47L 15/48* (2006.01)
*D06F 25/00* (2006.01)
*D06F 58/24* (2006.01)

(52) U.S. Cl.
CPC ..... *A47L 15/481* (2013.01); *A47L 15/486* (2013.01); *D06F 25/00* (2013.01); *D06F 58/24* (2013.01)

(58) Field of Classification Search
None
See application file for complete search history.

(56) References Cited

U.S. PATENT DOCUMENTS 4,277,290 A * 7/1981 Andrews ..... A47L 15/0002 134/10
2008/0173705 A1* 7/2008 Girard ..... A47J 31/402 235/375
2013/0055581 A1* 3/2013 Eichholz ..... A47L 15/481 34/202

FOREIGN PATENT DOCUMENTS

DE 10 2011 117 735 A1 2/2013
EP 2 561 791 A2 2/2013

* cited by examiner

*Primary Examiner* — Michael Barr
*Assistant Examiner* — Cristi Tate-Sims
(74) *Attorney, Agent, or Firm* — Breneman & Georges

(57) ABSTRACT

A drying apparatus for domestic machines such as dishwashers, washing machines or the like, having a liquid drying agent, a tank for the liquid drying agent and a rotatable distributor element for distributing the drying agent, and also a drive for the distributor element, wherein provision is made of a tank inlet for the return flow of the drying agent and a tank outlet for the removal of the drying agent, is proposed, said drying apparatus being improved in terms of leakage safety compared with the prior art. This is achieved according to the invention in that at least one closure element for closing the tank inlet and/or the tank outlet in a liquid-tight manner is provided.

20 Claims, 5 Drawing Sheets

DRYING APPARATUS FOR DOMESTIC MACHINES

Figure 1:
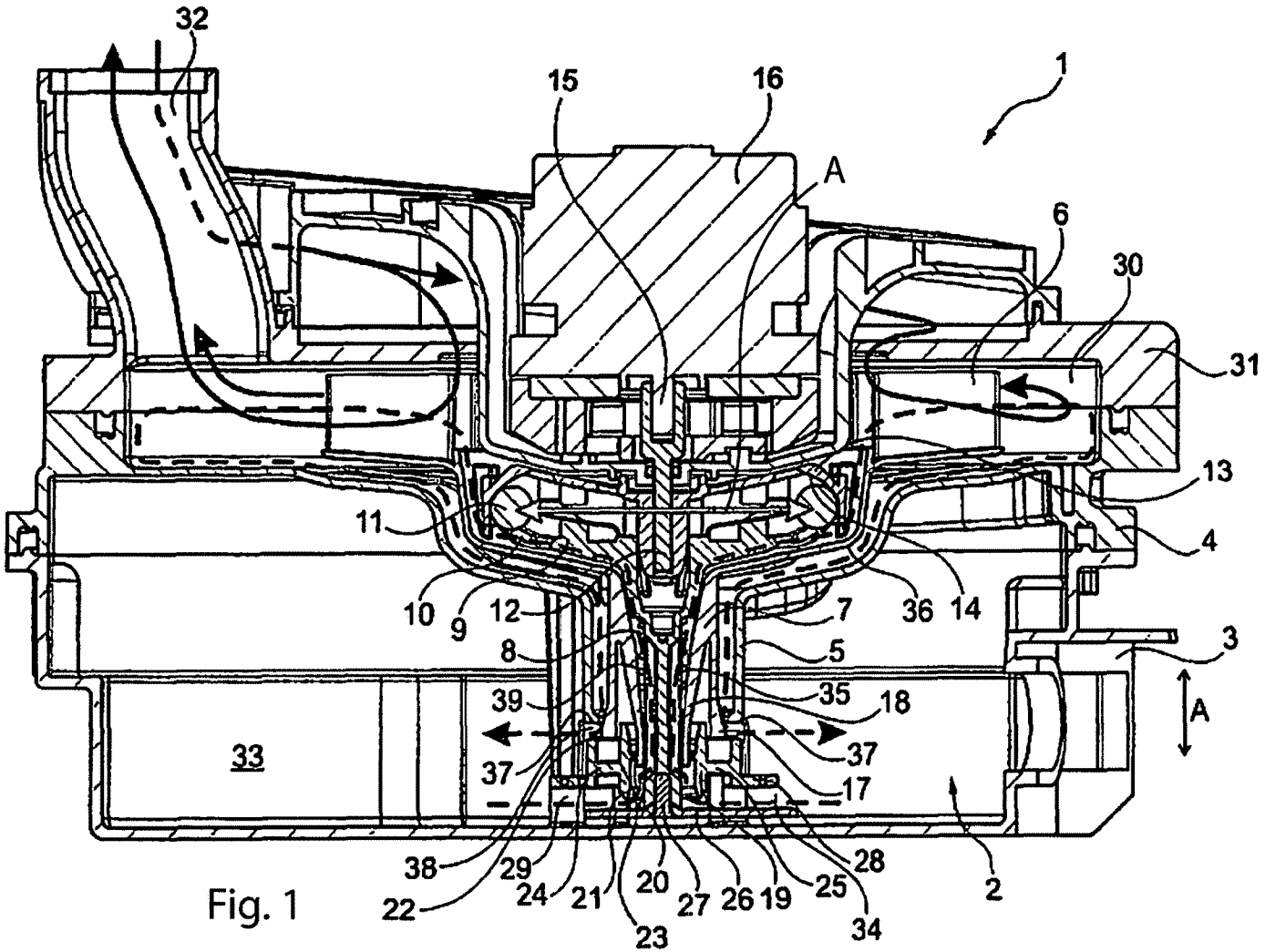

The invention relates to a drying apparatus for domestic machines such as dishwashers, washing machines or the like, according to the preamble of claim 1.

In particular in dishwashers, various drying apparatuses for drying the dishes following the dishwashing operation have already become known. Among others, apparatuses which can dehumidify air from the washing chamber of such a machine by means of a hygroscopic liquid are described. An apparatus of this kind is described for example in EP 2 561 791 A2.

One problem with drying apparatuses of this kind is that of ensuring that, when the drying apparatus or the domestic machine having such a drying apparatus is transported, the hygroscopic liquid which is used as drying agent does not leak out. In this case, care should be taken in particular to ensure that such a domestic machine can also assume a tilted position with respect to the operating position during transport.

In order to avoid leakage of the liquid drying agent, a geometry of the drying apparatus which is intended to ensure that the drying agent flows back into the corresponding storage container even after the domestic machine has been tilted was proposed in one particular embodiment according to the prior art. Such a domestic machine is described in the document DE 10 2011 117 735 A1.

It is the object of the present invention to improve leakage safety compared with the previously known prior art.

Proceeding from a drying apparatus according to the preamble of claim 1, this object is achieved by the characterizing features thereof.

As a result of the measures mentioned in the dependent claims, advantageous embodiments and developments of the invention are possible.

Accordingly, in a drying apparatus according to the invention having a tank for the liquid drying agent, having a tank inlet for the return flow of the drying agent and having a tank outlet for the removal of the drying agent, at least one closure element for closing the tank inlet and/or the tank outlet in a liquid-tight manner is provided.

Such a closure element reliably prevents the drying agent from being able to escape from the tank inlet and/or the tank outlet, regardless of the tilted position of the tank for the liquid drying agent.

Furthermore, complicated geometries for the design of a return flow, as are provided in the prior art, are dispensable. The leakage protection according to the invention is thus less complicated.

Advantageously, the tank inlet and the tank outlet are configured to be closable simultaneously, at least when the drying apparatus is idle. In this way, the drying apparatus, at least when it is idle, is completely insensitive with respect to tilting, for example during the transport of a domestic machine having such a drying apparatus, but also while the drying apparatus itself is being handled in the absence of the domestic machine, for example during transport and handling prior to fitting. Thus, in particular, it is also already possible to fill the drying apparatus with hygroscopic liquid or with liquid drying agent prior to fitting. The drying apparatus can be produced for example complete with filling and be delivered for fitting.

Furthermore, it is advantageous for the drying agent outlet to be closable even when the drying agent inlet is open. In this way, it is possible to ensure, prior to the tank being completely closed, that first of all the drying agent is prevented from exiting the tank into the drying apparatus. Then, it is possible to wait for a corresponding return flow period until the drying agent has passed as fully as possible back into the tank via the tank inlet, before the tank inlet is also closed.

This measure thus ensures that no substantial residual volume of drying liquid is located outside the tank when the drying apparatus or the domestic machine is idle.

In a particular embodiment, the closure element or a number of closure elements are configured in a controllable manner such that the corresponding closure of the tank inlet and/or of the tank outlet can be actuated by a machine controller.

Preferably, in order to control one or more closure elements, use is made of the rotational speed of a distributor element intended to distribute the drying agent or of the drive motor for the rotatable distributor element. In this way, in order to open or close the closure element or closure elements, no additional drive apparatus is required.

In an advantageous embodiment of the invention, one or more closure elements are configured to be movable in the axial direction with respect to the rotation axis of the distributor element for the drying liquid or the rotation axis of the associated drive motor. As a result of such a measure, tank inlet openings and tank outlet openings can be opened or closed by way of an axial movement.

Advantageously, the tank inlet and/or tank outlet are furthermore arranged at least in part concentrically about the rotation axis of the distributor element or of the drive of the distributor element.

In such an embodiment, the inlet and outlet openings can be provided for example in corresponding cylindrical walls of flow ducts for the drying agent, which are opened or closed by one or more axially displaceable closure elements.

In a particularly advantageous embodiment, the closure element is configured such that it comprises at least one axial seal. This axial seal, when pressed in the axial direction, seals against a sealing surface that is arranged transversely, preferably at right angles, thereto but could also be inclined at least in part, for example in order to form a runoff surface.

As a result of axial displacement of such an axial seal, a throughflow gap is opened or closed between the seal and the corresponding sealing surface. In the case of an annular axial seal, an annular gap arises between the axial seal and the sealing surface during opening, said annular gap being closed by an axial movement of the closure element during closing and being opened by an opposite movement.

Preferably, a closure element is provided with two axial seals such that two openings, i.e. a tank inlet opening and a tank outlet opening can be closed or opened with one closure element. In a particularly advantageous manner, these two axial seals are arranged on opposite sides with respect to the axial direction of the closure element.

Furthermore, it is advantageous to configure the two axial seals in a circular manner with different radii, such that different flow ducts that extend at least in part concentrically can be formed for the drying agent and can be closed with the closure element.

In the case of a closure element having two axial seals, as mentioned above, it is advantageous for an additional sealing element, which is likewise movable in the axial direction, to be provided with sealing surfaces for an axial seal. In this way, the two axial seals can be opened and closed separately and independently of one another.

In order to actuate the closure element, provision is advantageously made of a control cam element which has at least one radially extending cam path and at least one adjusting body that is movable radially, i.e. in the radial direction.

This rotatable control cam element is capable of corotating with the rotation of the radially movable adjusting bodies, such that these are subjected to a centrifugal force dependent on the rotational speed. As a result of the pressure of the adjusting body on a control cam, a force can then be generated in the axial direction, said force serving to close and open the tank inlet and/or tank outlet by means of the closure element via a mechanical connection to the closure element.

In a particularly advantageous embodiment, a control cam element that is stationary in the axial direction and a control cam element that is movable in the axial direction are provided, one or more adjusting bodies being arranged between said control cam elements so as to be movable in the radial direction. In this embodiment, the control cam element that is movable in the axial direction can be moved in the axial direction with respect to the stationary control cam element in a manner dependent on the rotational speed and thus as a result of the centrifugal force on the adjusting body.

Advantageously, the closure element is connected to the movable control cam element via one or more connecting elements, such that the closure element is movable and thus activatable by way of the axial movement of the control cam element.

In a preferred embodiment, a carrier element for carrying along the closure element is provided as connecting element between the closure element and the movable control cam element. This carrier element can, for example in the event of displacement, for example when the movable control cam element is raised, likewise displace the closure element, for example raise the latter.

Preferably, the carrier element is at the same time configured as a sealing element for one of the axial seals of the closure element. The carrier element can be detached from the closure element for example in an opposite movement to the carry-along movement, for example in a downward movement, when the closure element butts against a retaining element, for example a stop.

Furthermore, provision is preferably made of a restoring element, advantageously in the form of a restoring spring for setting the closed position of the closure element when the rotary drive is switched off and thus no centrifugal force acts on the adjusting body or bodies. This allows what is referred to as a failsafe behavior, i.e. in the idle state the tank outlet is safely closed.

This restoring spring can be intended for example to raise the movable control cam element such that in the case of a movable control cam element that is adjustable by centrifugal force, said control cam element can be restored again by means of the restoring element. If the movable control cam element drops for example by way of centrifugal force, it can be raised again by the restoring element.

The control cams of at least one control cam element, but preferably of both control cam elements, are preferably configured such that at least two, but advantageously three switching positions, for example stroke positions, of the closure element are settable via the rotational speed. Thus, for example in a cam path for the adjusting body, provision can be made of steps or bends which are only able to be overcome when a threshold value of the centrifugal force is exceeded. In this way, it is possible to assign different rotational speed ranges to different switching positions of the adjusting bodies and thus also of the movable control cam element. Thus, it is not necessary to set the rotational speed for actuating the states exactly; all that is necessary is for the particular range to be reached.

In a particularly advantageous embodiment, in this case three stroke positions are formed by the cam paths. With the rotary drive stationary, both the tank inlet and the tank outlet are intended to be closed. In a median rotational speed range, preferably the tank outlet is closed while the tank inlet remains open. This position serves to ensure that, for driving operation, drying agent located outside the tank is fed substantially fully back into the tank before the tank is completely closed by shutting off the rotary drive.

For operation of the drying apparatus, the full rotational speed is applied to the distributor element such that both the tank inlet and the tank outlet are open. In this state, the distributor element can withdraw drying liquid from the tank, distribute or atomize it in the drying chamber for air to be dried and return the drying liquid charged with water into the tank again.

The above-described adjusting body or bodies is/are preferably configured as balls in order to ensure optimal movability thereof on the cam paths and to avoid tipping.

As distributor element, use is preferably made of an impeller of a fan, such that this impeller serves the double function of transporting air out of the working chamber of the domestic machine, for example the dishwasher, and also of distributing the drying agent. As a result of this double function, the circulated air is permanently brought into contact with drying agent in the domestic machine, and so a corresponding exchange of moisture can take place.

Figure 2:
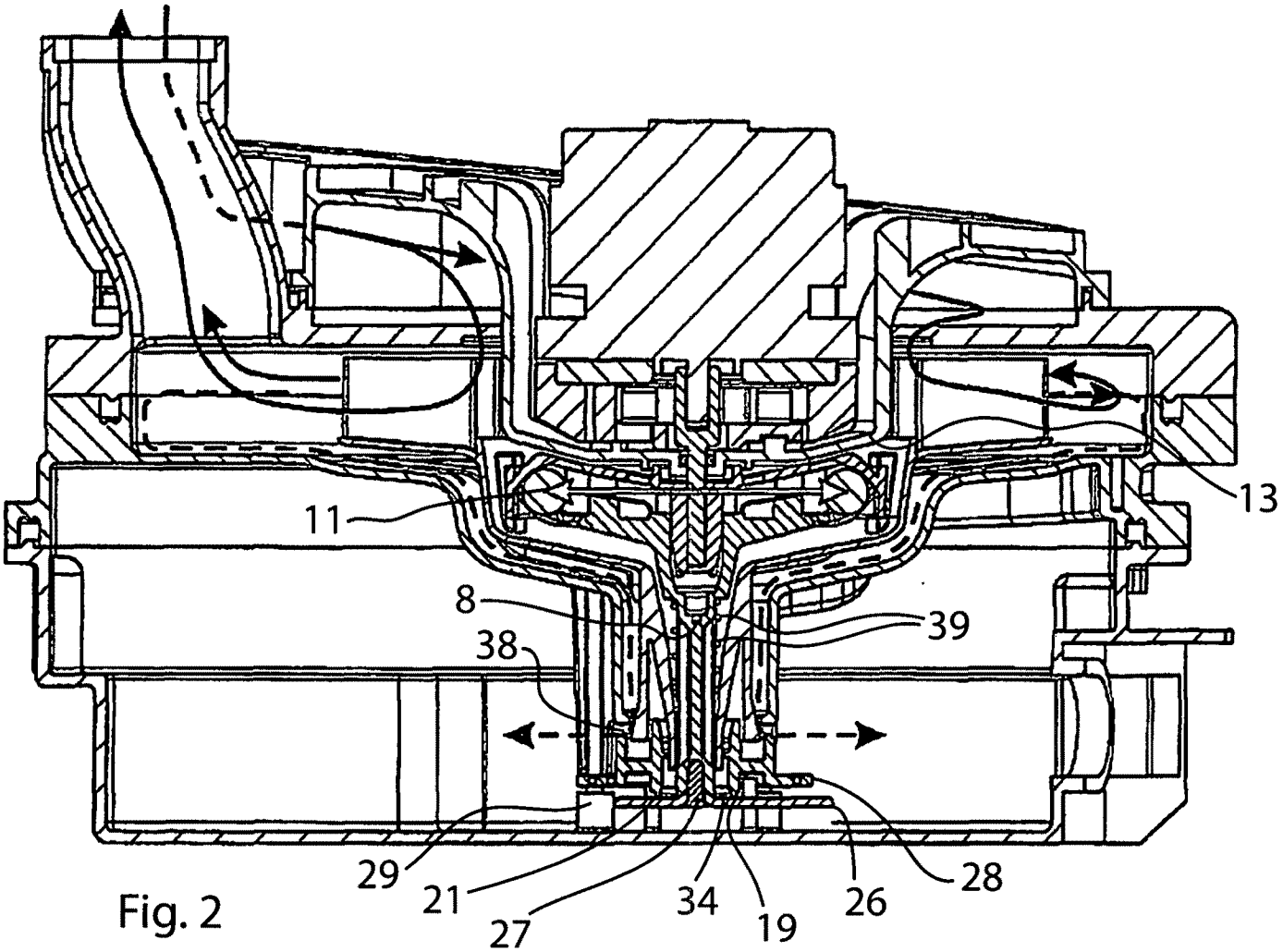
Figure 3:
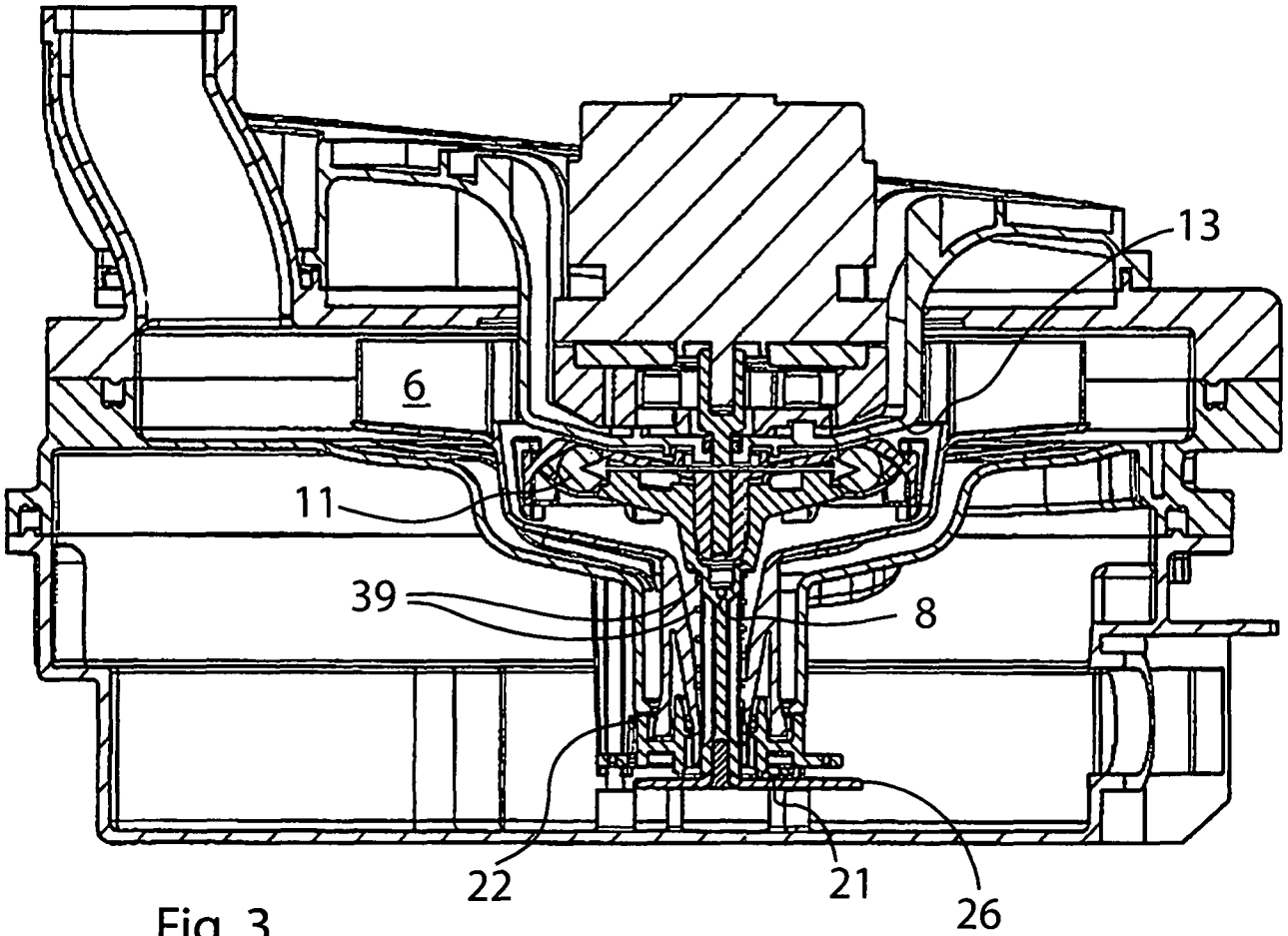
Figure 4:
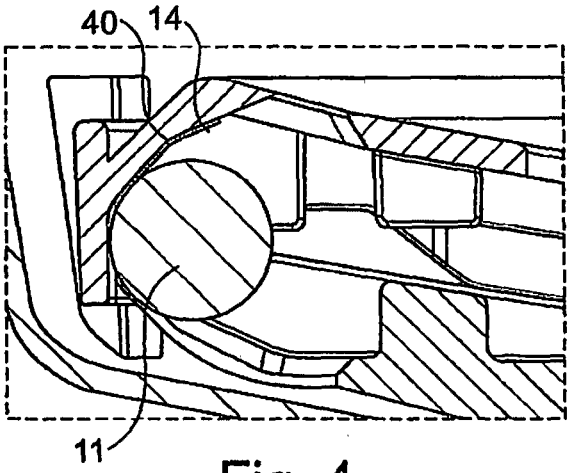
Figure 5:
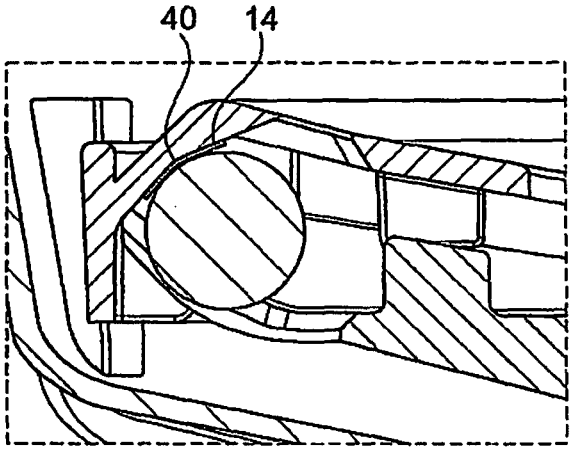
Figure 6:
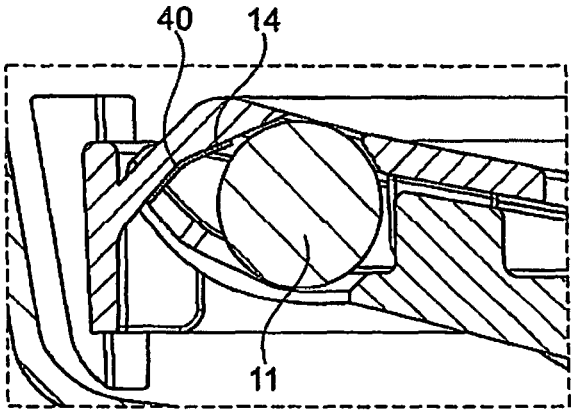
Figure 7:
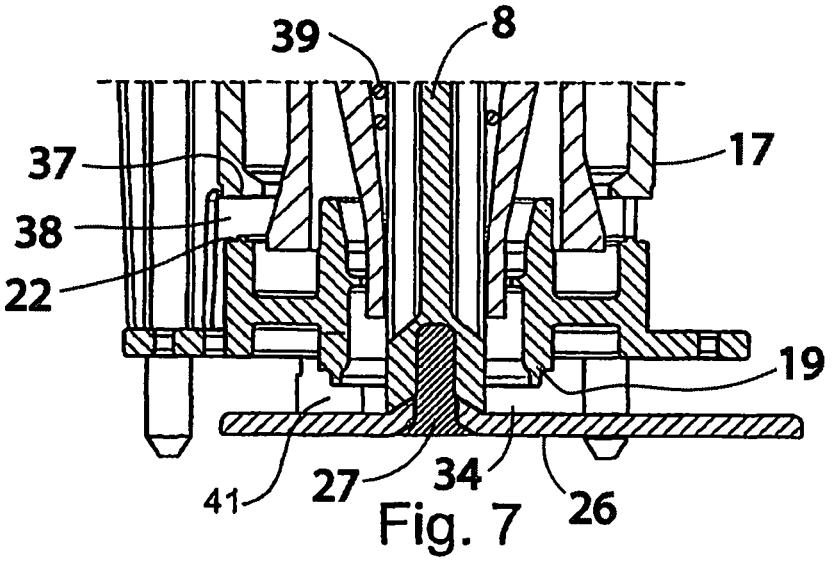
Figure 8:
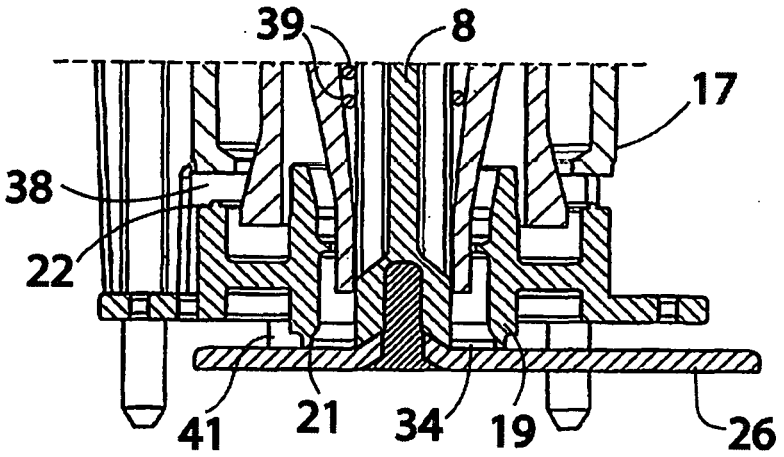
Figure 9:
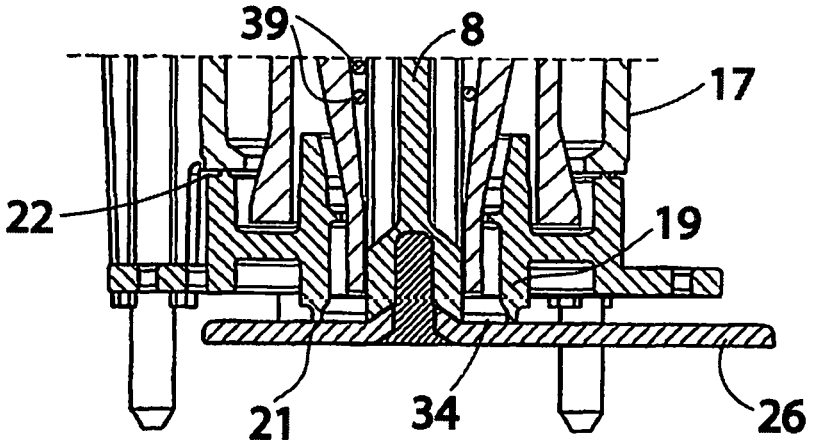

An exemplary embodiment of the invention is illustrated in the drawings and is explained in more detail in the following text with reference to the figures, in which, specifically:

FIG. 1 shows a schematic cross-sectional drawing through an apparatus according to the invention with an open inlet and an open outlet, FIG. 2 shows an illustration according to FIG. 1 with an open inlet and a closed outlet, FIG. 3 shows an illustration according to FIG. 1 with a closed inlet and a closed outlet, FIG. 4 shows a detail from FIG. 1, FIG. 5 shows a detail from FIG. 2, FIG. 6 shows a detail from FIG. 3, FIG. 7 shows a detail from FIG. 1, FIG. 8 shows a detail from FIG. 2, and FIG. 9 shows a detail from FIG. 3.

The apparatus 1 for drying according to FIG. 1 comprises a tank 2 having a base tub 3 and a cover 4. The cover 4 is turned inward in a funnel-like manner and reaches far into the base tub 3 with an outlet nozzle.

An impeller 6, which serves at the same time as a distributor element for drying liquid, follows the contour of the cover 4 in a more or less parallel manner and ends in an end tube 7 that extends in a substantially concentric manner with the outlet nozzle 5. Located on the opposite side of the end tube 7 from the cover 4 is a ram 8 which has a disk shape 9 on its upper side, cam paths 10 for adjusting balls 11 being arranged on the upper side of said disk shape 9. The ram 8 is movable in the axial direction (double arrow A). The ram 8 thus serves as a movable cam control element. Above the ram 8, a cam control element 13 that is rigidly connected to a drive shaft 12 is provided for conjoint rotation with the ram 8, said cam control element 13 having upper cam paths 14. The drive shaft 12 is connected to a motor output shaft 15 of an electric motor 16 for conjoint rotation.

The end tube 7 of the impeller 6 divides at its lower end into an external centrifugal element 17 and an internal guide tube 18. The guide tube 18 bears in a form-fitting manner against the lower end of the ram 8 and passes partially through a closure element 19. The closure element comprises a radial sealing lip 20 and two axial sealing lips, i.e. the lower axial sealing lip 21 and the upper axial sealing lip 22. The sealing lips 21, are attached to two mutually concentric annular subelements 23, 24 of the closure element 19 and are connected by a crosspiece 25 in the form of an annular disk.

A carrier element 26 is fastened to the underside of the ram 8 by means of a pivot bearing 27. The carrier element 26 can thus be moved in the axial direction via the ram 8 without rotating together therewith.

The closure element 19 furthermore comprises an external crosspiece 28 which extends laterally to the level of a number of stop elements 29 on the base of the base tub 3.

Located above the cover 4 is the drying chamber 30, in which the impeller 6 rotates and which is closed off by an upper cover 31. Provided in the upper cover 31 are feed air and discharge air elements, wherein only the discharge air tube 32 is discernible in the figures.

FIG. 1 shows the state operated at full rotational speed with open inlet and open outlet for the drying agent, as do FIG. 4 and FIG. 7.

The circulation of the drying agent 33 takes place in FIG. 1 as follows. The drying agent 33 is collected or stored in the base tub 3. The closure element 19 bears against the stop element 29 by way of the crosspiece 28 and is separated from the carrier element 26. Thus, an inlet annular gap 34, through which the drying agent, for example in the form of a lithium chloride solution, can pass into the interior of the inner subelement 23 of the closure element 9, arises between the carrier element 26 and the lower axial sealing lip 21. Through ducts 35 in the ram 8, the drying agent passes upward and through the intermediate spaces between the ram 8, the end tube 7 of the impeller 6 and the funnel-like intermediate part 36, which connects the end tube 7 to the impeller 6. In the region of the ducts 35, the ram 8 can be configured to form the ducts with a cruciform cross section, such that the ram 8 is suitable both for transmitting an axial tensile or compressive force and for transmitting torque and is thus permeable to liquid in the axial direction.

The drying agent then passes by way of an upward movement into the region of the impeller 6, where it is distributed in the drying chamber 30 and comes into contact with air to be dried.

The returning drying liquid, which has been augmented with moisture or charged with water, is collected via the funnel shape of the cover 4 and guided back downwardly into the outlet tube 5. By way of the centrifugal element 17, the drying liquid is spun off in the radial direction at the lower end and thus passes back into the tank 2 through an annular gap between an axial sealing surface 37 and the upper axial sealing lip 22. The annular gap 38 forms an outlet annular gap 38.

As is explained in more detail in the following text, the ram 8, in the position illustrated in FIG. 1, is pushed downward counter to the restoring pressure of a restoring spring 39 which is arranged between the ram 8 and the end tube 7 of the impeller. As a result, the carrier element 26 is also pushed downward in the direction of the base of the base tub 3, with the result that the closure element 19 bears against the stops 29 and the inlet annular gap 34 is opened.

The carrier element 26 is provided with carrier elements which are explained in more detail below, and so, although it is movable to a certain extent in the axial direction with respect to the closure element 19 in order to open the inlet annular gap 34, after the inlet annular gap has been opened, it is capable of entraining the closure element 19 further downward so that the outlet annular gap 38 is also opened.

As can be seen in FIG. 1, the adjusting balls 11 are located in their radial outer end position, i.e. FIG. 1 represents a position with maximum rotational speed.

At a median rotational speed, for example half the rotational speed, the state according to FIG. 2 is established. The restoring spring 39 pushes the ram 8 upward, while the adjusting balls 11 are located in a middle position with a median radius on account of the reduced centrifugal force. In this position, the carrier element 26 has been raised to such an extent that it bears against the lower axial sealing lip 21 such that the inlet annular gap 34 is closed.

The state according to FIG. 3 shows the motor in an idle state in which the impeller 6 does not rotate. In this position, the ram 8 has been raised into its upper end position by the restoring spring 39, while the adjusting balls 11 are located in their radially inner end position. On account of this stroke of the ram 8, the closure element 19 is raised further via the carrier element 26 such that the outlet annular gap 38 is closed, i.e. also such that the upper axial sealing lip 22 bears against the sealing surface 37. In this position, the tank 2 is thus completely closed, i.e. the drying liquid, for example the lithium chloride solution, is accommodated in a leak-proof manner.

FIG. 4 illustrates an enlarged detail from FIG. 1 in which the adjusting balls 11 have assumed their radially outer end position. In this illustration, it is in particular discernible that the upper cam path 14 has a bend 40. This bend 40 defines an intermediate position for the adjusting ball 11, as is illustrated in FIG. 5. This intermediate position corresponds to the operating state according to FIG. 2. In this case, the adjusting ball 11 is located in the bend 40, resulting in a certain stability of this position, which is only overcome when a certain threshold value of the centrifugal force and thus of the rotational speed is exceeded in order to assume the position according to FIG. 4.

The position according to FIG. 6 shows the resting position of the adjusting balls 11 in the upper end position of the ram 8. This position corresponds to FIG. 3.

The different positions of the closure element 19 are discernible in FIGS. 7 to 9.

FIG. 7 shows the completely open state, which corresponds to the maximum rotational speed and highest centrifugal force. The inlet annular gap 34 is open as well as the outlet annular gap 38. In the enlarged detail according to FIG. 7, a traction element 41 of the carrier element 26 is discernible, it being possible for said traction element 41 to be configured for example in the manner of a hook or as a latching element and to be axially displaceable to a certain extent with respect to the closure element 19. FIG. 7 shows the carry-along position of the carrier element 26, in which the carrier element 26 entrains the closure element 19 downward via the traction element 41. As a result of this traction by the traction element 41, the upper axial sealing lip 22 can be detached reliably from the sealing surface 37, and so it is not possible for any impeding adhesions to arise here.

FIG. 8 shows the outlined position at half the rotational speed, i.e. the ram 8 has been raised slightly, such that the carrier element 26 bears against the closure element 19 or the lower axial sealing lip 21 and seals off the inlet annular gap 34. In this position, returning drying liquid can still be conveyed back via the centrifugal element 17 through the outlet annular gap 38 into the tank.

When the rotational speed is reduced down to a standstill, the ram 8 is raised further by the restoring spring 39, wherein the carrier element 26 carries along the closure element 19 and raises it until the upper axial sealing lip 22 bears against the sealing surface 37 and the outlet annular gap 38 is also closed.

In this position, as already outlined, the tank 2 is completely closed.

When FIG. 7 and FIG. 8 are compared, the path length by which the traction element 41 is movable with respect to the closure element 19 can be seen. In the upward movement, the carrier element 26 thus acts directly as a carrier, in that the carrier element presses in a sealing manner against the lower sealing lip 21. In the downward movement, the carrier element 26 likewise acts as a carrier via the traction element 41, wherein this carry-along function starts only with the inlet annular gap 34 open.

The invention is not limited to the illustrated exemplary embodiment; all that is essential is that a closure element for closing the tank inlet and/or tank outlet in a liquid-tight manner in a drying apparatus according to the preamble of claim 1 is present. However, the illustrated exemplary embodiment shows advantageous developments with which additional improvements in the leakage protection are achievable.

LIST OF REFERENCE SIGNS

1 Apparatus
2 Tank
3 Base tub
4 Cover
5 Outlet nozzle
6 Impeller
7 End tube
8 Ram
9 Disk shape
10 Cam path
11 Adjusting ball
12 Drive shaft
13 Fixed cam control element
14 Upper cam path
15 Motor output shaft
16 Electric motor
17 Centrifugal element
18 Guide tube
19 Closure element
20 Radial sealing lip
21 Axial lower sealing lip
22 Axial upper sealing lip
23 Subelement
24 Subelement
25 Crosspiece
26 Carrier element
27 Pivot bearing
28 Crosspiece
29 Stop
30 Drying chamber
31 Upper cover
32 Discharge air tube
33 Drying liquid
34 Inlet annular gap
35 Duct
36 Intermediate part
37 Sealing surface
38 Outlet annular gap
39 Restoring spring
40 Bend
41 Traction element

What is claimed is:

1. In a drying apparatus for domestic machines having a liquid drying agent, a tank for the liquid drying agent and a rotatable distributor element for distributing the drying agent, and a drive for the distributor element, wherein provision is made for a tank inlet for the return flow of the drying agent and a tank outlet for the removal of the drying agent wherein the improvement comprises at least one closure element seal connected to a ram moveable in the axial direction for selectively closing the tank inlet and/or the tank outlet in a liquid-tight manner.

2. The apparatus according to claim 1 wherein the tank inlet and the tank outlet are closable simultaneously.

3. The apparatus according to claim 1 wherein the tank outlet is closable with the tank inlet open.

4. The apparatus according to claim 1 wherein the closure element seal is controllable by the rotational speed of the distributor element.

5. The apparatus according to claim 1 wherein the closure element seal is movable in the axial direction with respect to the rotation axis of the distributor element or an associated drive motor.

6. The apparatus according to claim 1 wherein the tank inlet and/or the tank outlet is/are arranged at least in part concentrically about the rotation axis of the distributor element or a drive motor for the distributor element.

7. The apparatus according to claim 1 wherein the closure element seal comprises at least one axial seal to close the tank inlet and/or tank outlet in an axial movement.

8. The apparatus according to claim 1 wherein the closure element seal comprises two axial seals.

9. The apparatus according to claim 1 further comprising a control cam element having at least one cam path that extends radially at least in part and at least one adjusting body that is at least in part radially movable.

10. The apparatus according to claim 1 further comprising a control cam element that is stationary in the axial direction with respect to the distributor element and a control cam element that is movable in the axial direction with respect to the distributor element.

11. The apparatus according to claim 1 wherein the closure element seal is connected to a movable control cam element.

12. The apparatus according to claim 1 further comprising a carrier element for carrying along the closure element seal said carrier element disposed between the closure element seal and a movable control cam element.

13. The apparatus according to claim 1 further comprising moveable cam control element and a restoring element for restoring the position of movable cam control element.

14. The apparatus according to claim 1 wherein when the apparatus is idle, the tank outlet is closed by a restoring element.

15. The apparatus according to claim 1 further comprising at least one control cam element having at least one cam path and at least two and preferably three stroke positions for the closure element seal settable by the rotational speed of the distributor element.

16. The apparatus of claim 1 wherein the drying apparatus is disposed in a dishwasher or washing machine.

17. A closure device for a drying apparatus having a hygroscopic drying agent comprising:

(a) a hygroscopic drying agent tank having an inlet and an outlet in an elevational spaced relationship;

(b) an impeller to move the hygroscopic liquid between the outlet, an appliance and the inlet, said impeller pump having a movable cam control element connected to a ram moveable in the axial direction to selectively engage the inlet and outlet in the elevational spaced relationship of the inlet and the outlet; and (c) a closure element operatively connected to the ram and moveable in the axial direction having a first closure device disposed in a first axial position to close the inlet and a second closure device disposed in a second axial position to close the outlet.

18. The closure device of claim 17 wherein the axial position of the closure element is controlled by the rotational speed of the impeller.

19. A drying apparatus comprising:

(a) a tank for containing a drying agent, said tank having an inlet and an outlet;

(b) a rotatable distributor element for removing the drying agent from the outlet of the tank and returning the drying agent to the inlet of the tank, said rotatable distributor element moveable in the axial direction with respect to the tank;

(c) a closure element connected to the rotatable distributor element and moveable in the axial direction with respect to the tank, said closure element having a first seal for the inlet of the tank disposed in one position along the length of the closure element and a second seal disposed in a second position for the outlet of the tank along the length of the closure element; and (d) a control element to axially move the closure element between at least two positions to open the inlet and outlet or to close the inlet and outlet depending upon the speed of the rotatable distributor element.

20. The drying apparatus of claim 19 further comprising a drive motor to operate the rotatable distributor element and the control element.

* * * * *